US009520667B2

(12) United States Patent
Tanigawa

(10) Patent No.: US 9,520,667 B2
(45) Date of Patent: Dec. 13, 2016

(54) CONNECTOR

(71) Applicant: Sumitomo Wiring Systems, Ltd., Yokkaichi, Mie (JP)

(72) Inventor: Norihiko Tanigawa, Mie (JP)

(73) Assignee: SUMITOMO WIRING SYSTEMS, LTD (JP)

( * ) Notice: Subject to any disclaimer, the term of this patent is extended or adjusted under 35 U.S.C. 154(b) by 0 days.

(21) Appl. No.: 14/870,692

(22) Filed: Sep. 30, 2015

(65) Prior Publication Data

US 2016/0118740 A1 Apr. 28, 2016

(30) Foreign Application Priority Data

Oct. 22, 2014 (JP) ..... 2014-215000

(51) Int. Cl.
*H01R 13/42* (2006.01)
*H01R 13/424* (2006.01)
*H01R 13/447* (2006.01)

(52) U.S. Cl.
CPC ..... *H01R 13/42* (2013.01); *H01R 13/424* (2013.01); *H01R 13/447* (2013.01)

(58) Field of Classification Search
CPC ..... H01R 13/52; H01R 13/528; H01R 13/42
See application file for complete search history.

(56) References Cited

U.S. PATENT DOCUMENTS 4,435,034 A * 3/1984 Aujla ..... H01R 4/2433 439/404
5,921,805 A * 7/1999 Tabata ..... H01R 13/5804 439/457
6,146,198 A * 11/2000 Maeda ..... H01R 13/5202 439/587
6,176,745 B1 * 1/2001 Furutani ..... H01R 13/506 439/701
6,231,398 B1 * 5/2001 Furutani ..... H01R 13/506 439/701
6,443,766 B2 * 9/2002 Ichio ..... 439/274
7,147,503 B2 12/2006 Shindo
8,023,272 B2 * 9/2011 Shimizu ..... H01R 4/185 361/752
2001/0019917 A1 * 9/2001 Sato ..... H01R 13/415 439/459

(Continued)

FOREIGN PATENT DOCUMENTS

JP 2005-116395 4/2005

*Primary Examiner* — Briggitte R Hammond

(74) *Attorney, Agent, or Firm* — Gerald E. Hespos; Michael J. Porco; Matthew T. Hespos

(57) ABSTRACT

A connector (10) includes a main body (11) including terminal accommodating portions (16A, 16B) capable of accommodating terminal fittings (60) and a cover (12) to be mounted on the main body (11) to cover the terminal fittings (60) accommodated in the terminal accommodating portions (16A, 16B). Wire draw-out openings (23) from which wires (90) are drawn out are formed to be open between joint parts of the cover (12) and the main body (11) with the cover (12) mounted on the main body (11). Resilient supporting portions (24) are provided on opening edge parts of the wire draw-out openings (23) for supporting the wires (90) by resiliently contacting outer peripheral surfaces of the wires (90) at a plurality of circumferentially spaced-apart positions.

12 Claims, 5 Drawing Sheets

(56) References Cited

U.S. PATENT DOCUMENTS

| | | | | |
|---|---|---|---|---|
| 2001/0055904 | A1* | 12/2001 | Sawada | H01R 13/5837<br>439/449 |
| 2005/0020136 | A1* | 1/2005 | Johannes | H01R 13/7197<br>439/620.07 |
| 2015/0280359 | A1* | 10/2015 | Nagy | H01R 13/5812<br>439/470 |

* cited by examiner

CONNECTOR

BACKGROUND

1. Field of the Invention

This invention relates to a connector.

2. Description of the Related Art

Japanese Unexamined Patent Publication No. 2005-116395 discloses an electrical connection device (connector) that includes a connecting connector element with a terminal supporting portion for supporting two connection terminals connected to end parts of conductive wires and a cover to be mounted on the connecting connector element to sandwich the connection terminals by covering an upper opening of the connecting connector element. Grooves are provided on an end part of the connecting connector element to allow the passage of the wires. A wire pressing portion projects from the cover at a position corresponding to the grooves. The wire pressing portion presses the wires when the cover is mounted on the connecting connector element to prevent the wires from coming out of the grooves. Thus, the wires are pressed firmly between the wire pressing portion and groove surfaces, so that the wires do not move loosely in the grooves, and rattling of the connection terminals can be suppressed even if the wires drawn out to outside are, for example, pulled. However, wire holding spaces between the wire pressing portion and the groove surfaces are of fixed size, and the holding spaces cannot be changed if diameters of the wires are changed. Thus, there is a problem of having to prepare a plurality of devices corresponding to diameters of conductive wires.

The invention was completed based on the above situation and aims to provide a connector capable of holding a wire even if a wire diameter is changed.

SUMMARY

The invention is directed to a connector including a terminal fitting connected to an end part of a wire. The connector has a main body with a terminal accommodating portion capable of accommodating the terminal fitting. A cover is to be mounted on the main body to cover the terminal fitting accommodated in the terminal accommodating portion. A wire draw-out opening is formed between joint parts of the cover and the main body when the cover is mounted on the main body and enables the wire to be drawn out being. A resilient support is provided on an opening edge part of the wire draw-out opening for supporting the wire by resiliently contacting an outer peripheral surface of the wire at a plurality of circumferentially spaced positions.

The resilient support supports the wire by resiliently contacting the outer peripheral surface of the wire when the wire is inserted into the wire draw-out opening between the joint parts of the cover and the main body. Thus, a change of the wire diameter can be accommodated by one connector. Further, the resilient support is in contact with the outer peripheral surface of the wire at the plurality of circumferentially spaced-apart positions. As a result, the wire is held stably in the wire draw-out opening.

The resilient support may be formed into a corrugated shape and may be expandable and contractible in a radial direction of the wire. Thus, the resilient support is in contact with the outer peripheral surface of the wire at the plurality of circumferentially spaced positions.

The resilient support is provided on an opening edge of the wire draw-out opening on at least one of the main body and the cover for resiliently sandwiching and holding the wire between the resilient support and the opposed surface. Thus, the resilient support may be provided on only one of the main body and the cover.

DETAILED DESCRIPTION

A connector 10 to be connected to an airbag device of an automotive vehicle incorporating an inflator is illustrated in FIGS. 1-5. The connector 10 includes a main body 11, terminal fittings 60 to be accommodated into the main body 11 and a cover 12 to be mounted on the main body 11. The main body 11 is connectable to an unillustrated mating connector. Note that, in the following description, a surface facing the mating connector at the start of connection is referred to as a front end concerning a front-back direction. A vertical direction is based on FIGS. 3 and 5 and a lateral direction is based on each figure.

Figure 1:
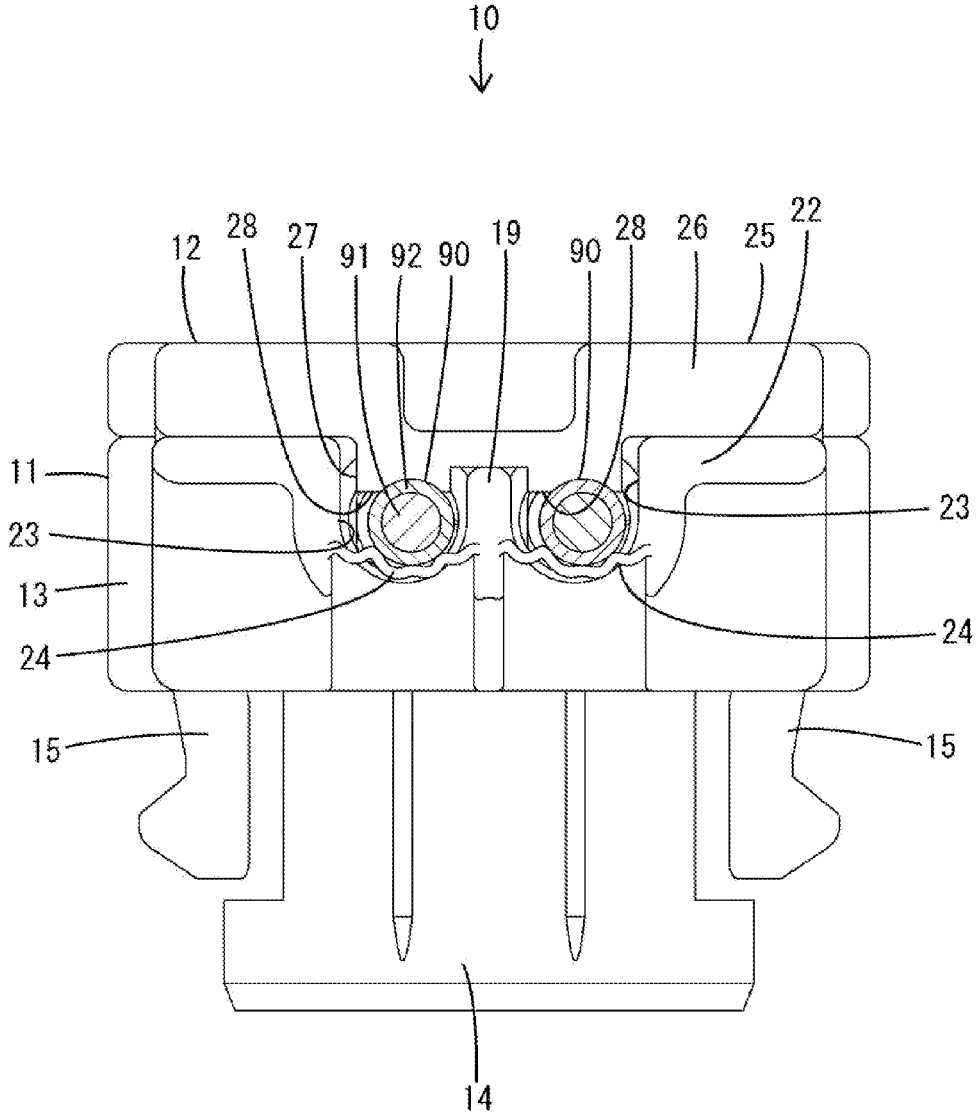
FIG. 1 is a bottom view of a connector according to an embodiment of the invention.
Figure 2:
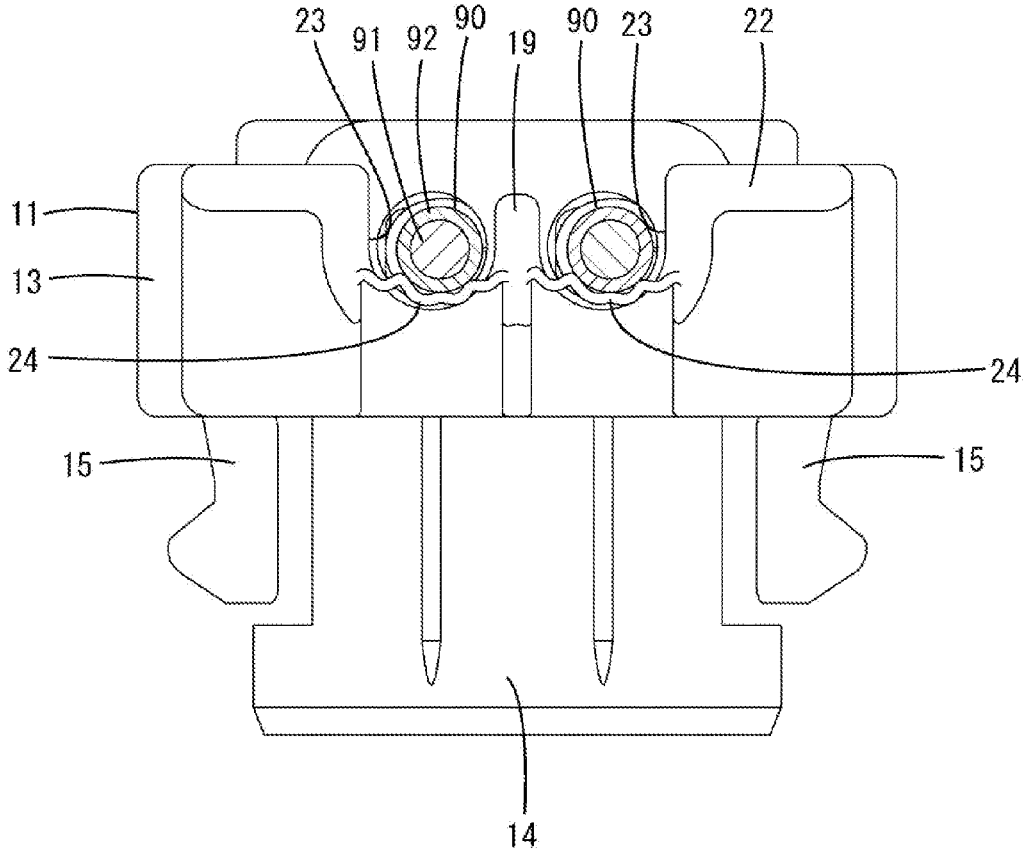
FIG. 2 is a bottom view of a main body in which terminal fittings are accommodated.
Figure 3:
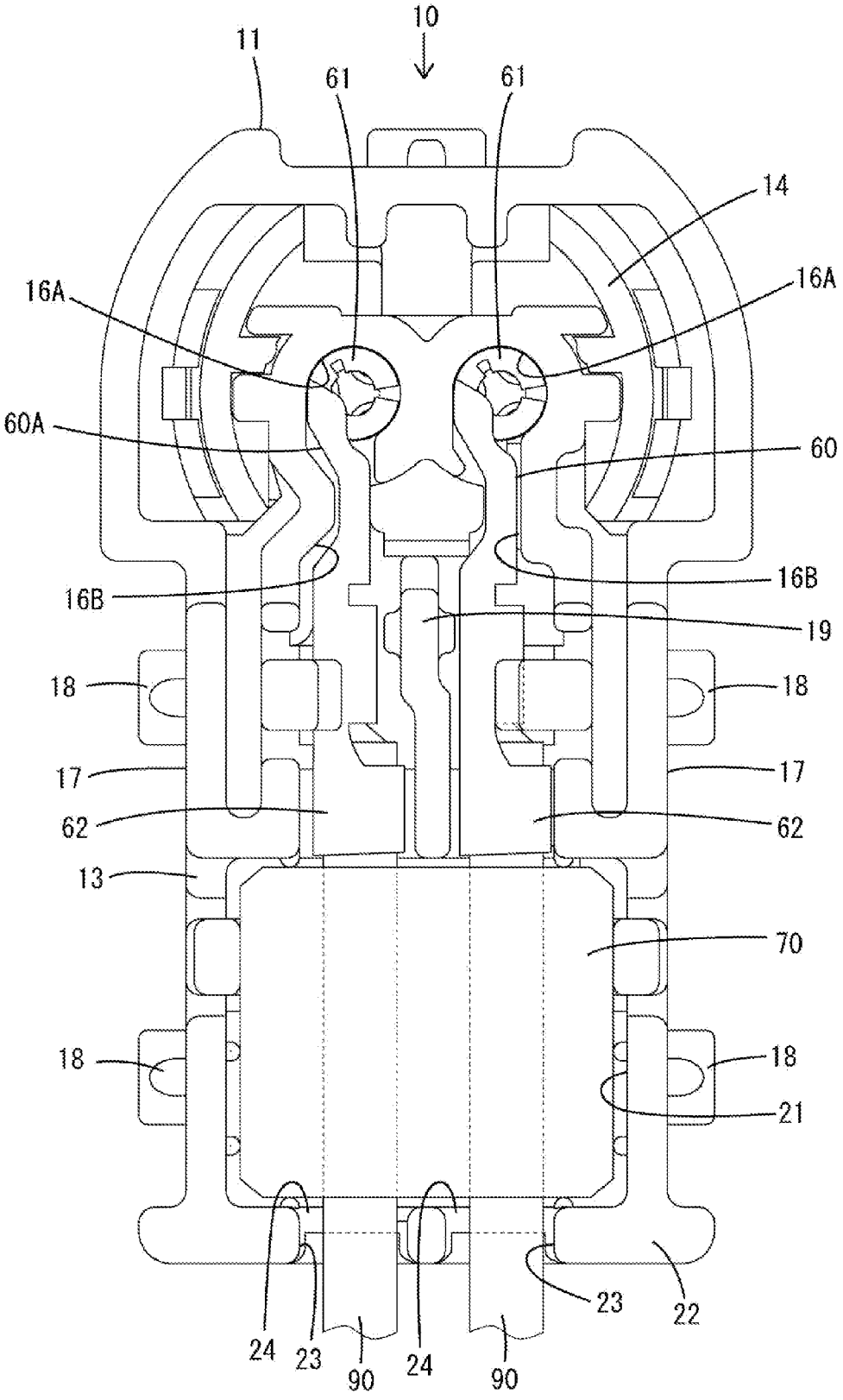
FIG. 3 is a rear view of the main body show in FIG. 2.

The terminal fitting 60 is formed integrally or unitarily such as by bending an electrically conductive metal plate. More particularly, the terminal fitting 60 includes a substantially hollow cylindrical terminal connecting portion 61 extending along the front-back direction and a barrel-like wire connecting portion 62 extending along the vertical direction. The terminal connecting portion 61 and the wire connecting portion 62 are aligned to define a substantially L shape in a side view, as shown in FIG. 3. An unillustrated mating terminal fitting mounted in the mating connector and is connectable to the terminal connecting portion 61 by being inserted. Further, the wire connecting portion 62 is crimped and connected to an end part of a wire 90. As shown in FIGS. 1 and 2, the wire 90 is an insulated wire and has a core 91 surrounded by a coating 92.

Figure 4:
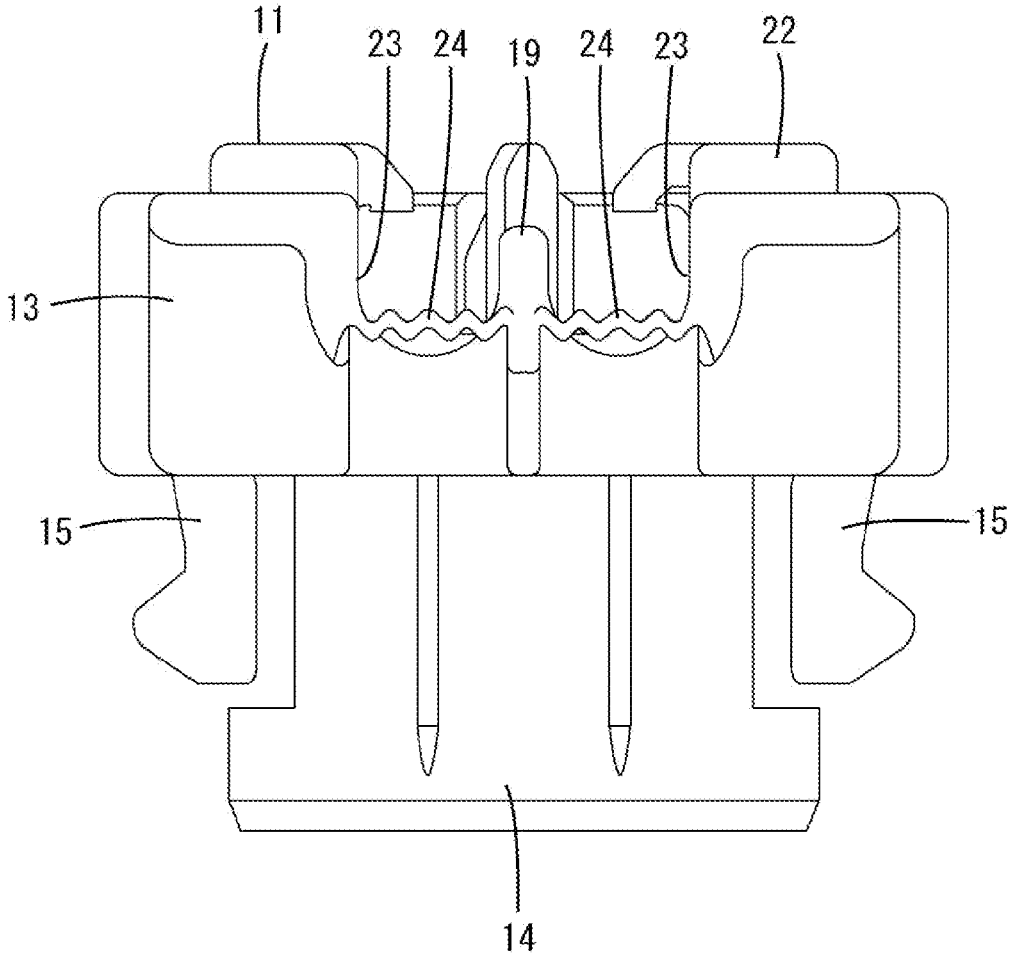
FIG. 4 is a bottom view of the main body.

The main body 11 is made of synthetic resin to define a vertically long rectangular base 13 extending along the vertical direction and a fitting protrusion 14 projecting unitarily forward from an upper part of the base 13 (see FIGS. 4 and 5), thereby forming a substantially L-shape in a side view. A receptacle of the unillustrated mating connector is fit externally on the fitting protrusion 14. As shown in FIG. 4, two lock arms 15 project at opposite left and right sides of a front part of the base 13. The lock arms 15 can resiliently lock to the receptacle for holding the connector 10 in a state connected to the mating connector.

Figure 5:
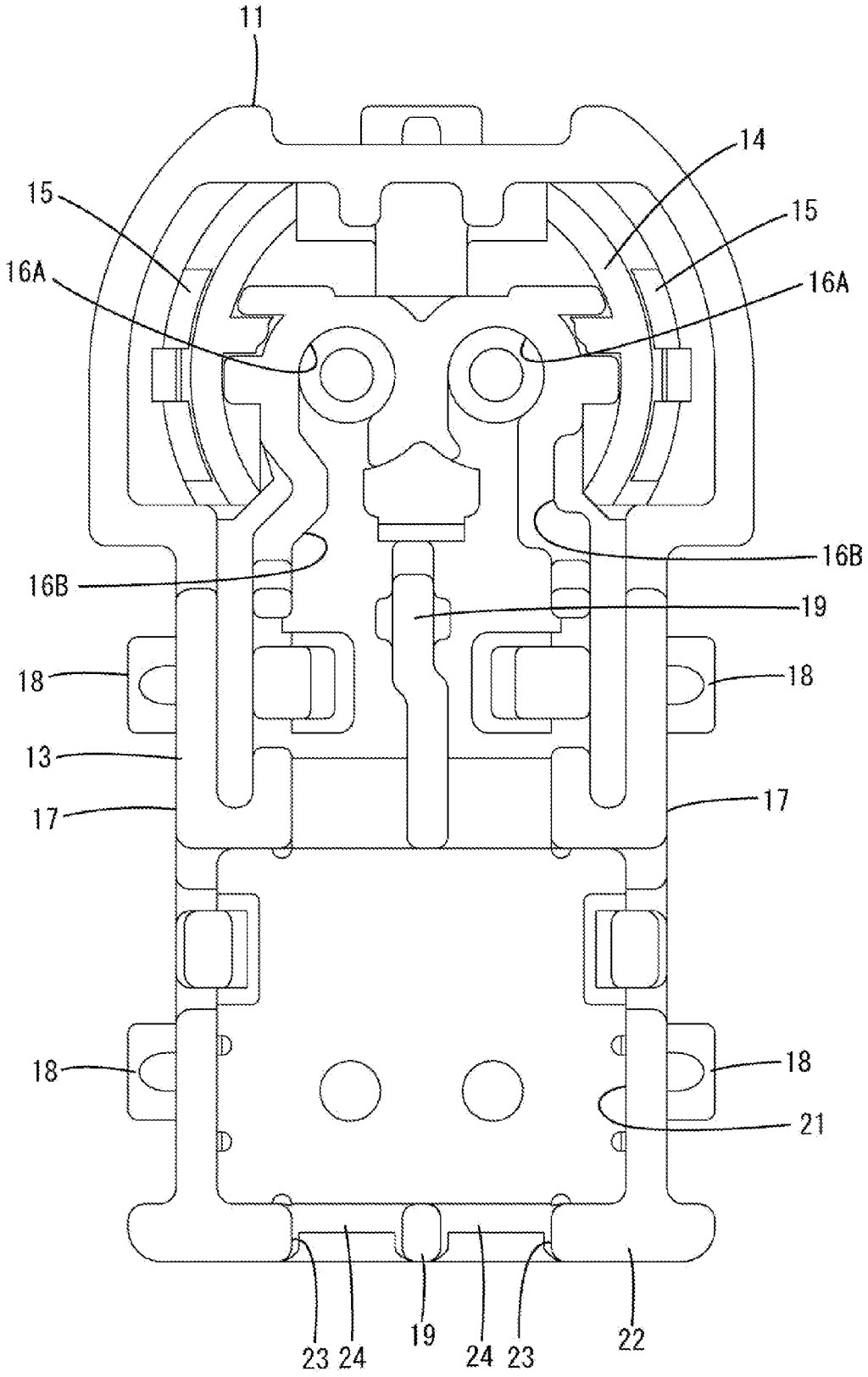
FIG. 5 is a rear view of the main body shown in FIG. 4.

As shown in FIG. 5, left and right terminal accommodating portions 16A penetrate through the fitting protrusion 14 in the front-back direction. The terminal accommodating portion 16A has a circular cross-section and the terminal connecting portion 61 of the terminal fitting 60 is inserted and accommodated therein from behind. Note that a structure for locking the terminal fitting 60 is not provided in either the terminal accommodating portion 16A or a terminal accommodating portion 16B on the side of the base 13 (to be described later). Rather, the cover 12 prevents the terminal fitting 60 from coming out backward.

As shown in FIG. 5, two vertically extending side walls 17 are provided on opposite left and right sides of the base 13. Two vertically spaced locks 18 are provided on each of the side walls 17. Later-described lock pieces of the cover 12 are locked resiliently to the locks 18 for retaining the cover 12 on the main body 11.

As shown in FIG. 5, left and right terminal accommodating portions 16B are provided at the rear of the base 13. The terminal accommodating portions 16B are in the form of vertically extending, rearwardly open grooves, the upper ends of which communicate with the rear ends of the terminal accommodating portions 16A of the fitting protrusion 14. A partition wall 19 partitions the terminal accommodating portions 16B. As shown in FIG. 3, the terminal accommodating portion 16B is shaped to substantially correspond to the wire connecting portion 62 of the terminal fitting 60, and the wire connecting portion 62 of the terminal fitting 62 is inserted therein from behind and accommodated in a substantially positioned state. The wire 90 extending from the terminal fitting 60 also is accommodated in a substantially positioned state in the terminal accommodating portion 16B.

As shown in FIG. 5, a fitting recess 21 is provided by cutting the partition wall 19 between lower end parts of the terminal accommodating portions 16B on the rear surface of the base 13 and has a substantially rectangular opening in a rear view. As shown in FIG. 3, a ferrite member 70 for noise reduction is inserted into the fitting recess 21 from behind and is accommodated in a fitted state. The wires 90 are inserted vertically through the ferrite member 70.

As shown in FIGS. 4 and 5, an end wall 22 (joint part on the side of the main body portion 11) extends laterally on the lower end of the base 13. Opposite left and right ends of the end wall 22 are connected integrally to the lower ends of the side walls 17. Left and right wire draw-out openings 23 are open in a substantially lateral central part of the end wall 22. The wire draw-out openings 23 communicate with the terminal accommodating portions 16B and are open on the rear end of the end wall 22. The wire draw-out openings 23 are partitioned by the partition wall 19. The wires 90 are drawn out to outside from the wire draw-out openings 23 while being accommodated in the terminal accommodating portions 16B.

As shown in FIG. 4, a resilient support 24 is provided on an opening edge part of each wire draw-out opening 23 of the end wall 22 to extend between opposite left and right side surfaces of a lower end part of the opening edge part while being supported on both ends. Each resilient support 24 extends laterally and is in the form of a corrugated strip having a wavy cross-section in which peaks and troughs are repeated alternately and continuously. When the wire 90 is inserted through the wire draw-out opening 23, the resilient support 24 contacts the outer peripheral surface of a substantially lower half of the wire 90 and is deflected and deformed to be curved down, as shown in FIG. 2. At this time, tips of the peaks of the resilient support 24 are in contact with the outer peripheral surface of the substantially lower half of the wire 90 at plural circumferentially spaced positions, specifically at three or more positions. Thus, the wire 90 is supported resiliently from below by the resilient support 24. Troughs of the resilient support 24 are not in contact with the outer peripheral surface of the wire 90. As shown in FIG. 5, each resilient support 24 is provided at an inner side in a thickness direction of the end wall 22.

The cover 12 also is made of synthetic resin and, although not shown in detail, includes a vertically long rectangular covering plate 25. Two lock pieces (not shown) project forward from opposite left and right edges of the covering plate 25. The cover 12 is mounted on the base 13 from behind so that the covering plate 25 covers a rear surface opening of the base 13. The covering plate 25 is held in contact with the rear ends of both side walls 17 and the end wall 22 of the base 13, with the lock pieces placed on outer sides of the side walls 17. The lock pieces are locked resiliently to the corresponding locks 18 to hold the cover 12 on the main body 11.

As shown in FIG. 1, an end wall 26 (joint part on the side of the cover plate 12) on a lower side of the covering plate 25 has a wire pressing portion 27 defining upper parts of the wire draw-out openings 23 and projecting forward from a substantially lateral central part. Two side-by-side pressing main bodies 28 extend laterally on a projecting end of the wire pressing portion 27. The pressing main bodies 28 contact the outer peripheral surfaces of the wires 90 when the cover 12 is mounted on the main body 11 and the wires 90 are sandwiched vertically and held between the pressing main bodies 28 and the resilient supports 24.

The terminal fittings 60 are inserted into the terminal accommodating portions 16A, 16B of the main body 11 and then the cover 12 is mounted on the main body 11. The wire connecting portions 62 of the terminal fittings 60, the wires 90 extending down from the wire connecting portions 62 and the ferrite member 70 through which the wires 90 are inserted are accommodated into the terminal accommodating portions 16B of the base 13 of the main body 11 and, in that state, the rear opening of the base 13 is closed by the covering plate 25 of the cover 12. Further, when the cover 12 is mounted as shown in FIG. 1, the pressing main bodies 28 of the wire pressing portion 27 contact upper end parts of the outer peripheral surfaces of the wire 90 to press the wires 90 down. Associated with that, the resilient supports 24 are curved resiliently and deformed down. At this time, the resilient support 24 supports the wire 90 from below by resiliently contacting the outer peripheral surface of the substantially lower half of the wire 90 at plural of circumferentially spaced positions and each wire 90 is sandwiched and held in a loose movement regulated state between the pressing main body 28 and the resilient support 24.

The resilient support 24 has a corrugated shape and hence is expandable and contractible in a radial direction of the wire 90. Thus, a change in an outer diameter of the wire 90) can be dealt with. For example, if the wire diameter becomes smaller than that of the wire 90, the resilient support 24 supports the small-diameter wire 90 from below with a smaller deflection amount than in the above case. Further, if the wire diameter becomes larger than that of the wire 90, the resilient support 24 supports the large-diameter wire 90 from below with a larger deflection amount than in the above case. In this way, even if the wire diameter is changed, a state where the resilient support 24 is in contact with the outer peripheral surface of the substantially lower half of each wire 90 at the plural positions is maintained and loose movements of each wire 90 in the wire draw-out opening 23 are suppressed.

As described above, the wires 90 are inserted through the wire draw-out openings 23 formed between the end walls 22, 26 of the main body 11 and the cover 12 and the resilient supports 24 resiliently contact the outer peripheral surfaces of the inserted wires 90 at the plural circumferentially spaced positions to support the wires 90. Thus, even if the wire diameter is changed, a difference in the wire diameter can be absorbed by the amount of resilient deflection of the resilient supports 24 and a wire diameter change can be dealt with by one connector 10. In addition, the wire 90 is held stably in the wire draw-out opening 23 by the contact of the resilient support 24 with the outer peripheral surface of the wire 90 at the plural positions. More particularly, the resilient support 24 is formed into a corrugated shape to be expandable and contractible in the radial direction of the wire 90. Thus, the state where the resilient support 24 is in contact with the outer peripheral surface of the wire 90 at the plurality of positions is ensured.

Further, since the cover 12 is not provided with the resilient supporting portions 24 and the existing cover 12 can be used as it is. Hence, the structure of the connector 10 is not complicated more than necessary and manufacturing cost can be suppressed.

The invention has been described with respect to one embodiment. However various changes can be made without departing from the scope of the invention defined by the claims. Some of the changes that are within the scope of the invention are described below.

The resilient supports may be provided on opening edge parts of wire draw-out openings on the end wall of the cover.

The resilient supports may be provided on the opening edge parts of the wire draw-out openings on the both end walls of the main body and the cover.

The wire draw-out openings may be formed by recessing the end wall of the cover to be able to receive the wires.

The main body and the cover may be coupled integrally via a hinge.

LIST OF REFERENCE SIGNS

10 connector
11 main body
12 cover
16A terminal accommodating portion (terminal accommodating portion on fitting protrusion side)
16B terminal accommodating portion (terminal accommodating portion on base portion side)
22 end wall (end wall of main body portion side (joint part))
26 end wall (end wall of cover portion side (joint part))
23 wire draw-out opening
24 resilient supporting portion
90 wire

What is claimed is:

1. A connector, comprising:

a terminal fitting connected to an end part of a wire;

a main body including a terminal accommodating portion capable of accommodating the terminal fitting; and a cover to be mounted on the main body to cover the terminal fitting accommodated in the terminal accommodating portion;

a wire draw-out opening from which the wire is drawn out being formed between the cover and the main body with the cover mounted on the main body and at least one resilient support provided on an opening edge part of the wire draw-out opening for supporting the wire by resiliently contacting an outer peripheral surface of the wire at a plurality of circumferentially spaced positions.

2. The connector of claim 1, wherein the resilient support has a corrugated shape and is expandable and contractible in a radial direction of the wire.

3. The connector of claim 2, wherein the resilient support is provided at an opening edge of the wire draw-out opening on one of the main body and the cover and resiliently sandwiches and holds the wire in the wire draw-out opening.

4. The connector of claim 3, wherein the resilient support is unitary with the main body.

5. The connector of claim 4, wherein the resilient support is not provided on the cover.

6. The connector of claim 3, wherein the resilient support has plural peaks and troughs, at least three of the peaks engaging the outer peripheral surface of the wire.

7. The connector of claim 3, wherein the resilient support has opposite ends joined unitarily to the main body at the wire draw-out opening and wherein areas of the resilient support between the opposite ends are spaced from surfaces of the main body that define the wire draw-out opening.

8. The connector of claim 1, wherein the resilient support is provided on an opening edge of the wire draw-out opening on one of the main body and the cover and resiliently sandwiches and holds the wire in the wire draw-out opening.

9. The connector of claim 8, wherein the resilient support is unitary with the main body.

10. The connector of claim 9, wherein the resilient support is not provided on the cover.

11. The connector of claim 8, wherein the resilient support has plural peaks and troughs, at least three of the peaks engaging the outer peripheral surface of the wire.

12. The connector of claim 8, wherein the resilient support has opposite ends joined unitarily to the main body at the wire draw-out opening and wherein areas of the resilient support between the opposite ends are spaced from surfaces of the main body that define the wire draw-out opening.

* * * * *